US005439733A

United States Patent [19]

Paire

[11] Patent Number: 5,439,733

[45] Date of Patent: Aug. 8, 1995

[54] INSERT INTENDED FOR USE IN THE CLOTHING INDUSTRY

[75] Inventor: Christian Paire, Roisel, France

[73] Assignee: Lainiere de Picardie, Peronne, France

[21] Appl. No.: 13,317

[22] Filed: Feb. 4, 1993

Related U.S. Application Data

[63] Continuation-in-part of Ser. No. 541,961, Jun. 22, 1990, abandoned.

[30] Foreign Application Priority Data

Jun. 26, 1989 [FR] France ..... 89 08461

[51] Int. Cl.[6] ..... B32B 5/00

[52] U.S. Cl. ..... 428/219; 428/220; 428/286; 428/288; 428/290; 428/296; 428/304.4; 428/306.6; 428/308.4; 428/310.1; 428/311.1; 428/311.5; 428/311.7; 428/315.5; 428/315.7; 428/316.6; 428/317.5; 428/317.9

[58] Field of Search ..... 428/306.6, 219, 220, 428/286, 88, 290, 296, 304.4, 306.6, 308.4, 310.5, 311.1, 311.5, 311.7, 315.5, 315.7, 316.6, 317.5, 317.9

[56] References Cited

U.S. PATENT DOCUMENTS 4,761,326 8/1988 Barnes et al. ..... 428/219

*Primary Examiner*—Patrick J. Ryan
*Assistant Examiner*—Rich Weisberger
*Attorney, Agent, or Firm*—Popham, Haik, Schnobrich & Kaufman, Ltd.

[57] ABSTRACT

The present invention relates to a breathable and impermeable insert intended for use in the clothing industry. In a preferred embodiment, the insert comprises a microporous polymer foam layer embedded in a textile substrate. The foam layer is mechanically reinforced by a textile substrate, and, due to the flexibility of the foam, the textile retains most of its feel and flexibility. The foam is water vapor permeable, but liquid water impermeable. Methods for easily producing breathable textile inserts are disclosed.

9 Claims, 2 Drawing Sheets

INSERT INTENDED FOR USE IN THE CLOTHING INDUSTRY

This application is a Continuation-In-Part application of U.S. patent application Ser. No. 07/541,961, filed Jun. 22, 1990, now abandoned.

FIELD OF THE INVENTION

The present invention relates to an insert intended for use in the clothing industry, and more particularly is directed to a water vapor permeable and liquid water impermeable insert for use in the clothing industry, comprising a microporous foam polymer layer and a textile substrate, wherein the microporous layer comprises a stable foam and the foam layer permeates the textile substrate, and wherein the textile substrate mechanically reinforces the foam layer.

BACKGROUND OF THE INVENTION

Textile products for use in the clothing industry and the processes for their manufacture are developing rapidly. Since about 1985, semi-permeable products have been developed which are impermeable to water, but which let carbon dioxide and water vapor pass through; such products are labelled as breathable. These products protect the user from rain and wind while remaining perfectly comfortable to wear.

To this end, products in which a semi-permeable layer or film is directly applied to a cloth are known. Other products are also known in which an insert forms a semi-permeable barrier in clothes. Breathable inserts are generally made by gluing a semi-permeable film to a textile support. Such inserts can, in addition to modifying the impermeable properties of a garment, serve their usual purpose of altering the mechanical properties of a garment. Inserts are generally attached to a textile substrate by use of a discontinuous thermofusible polymer.

All of the prior art techniques for producing "breathability" are relatively restricting, and the presence of a semi-permeable layer makes it difficult to control the appearance, feel and hang of the textile.

Moreover, the semi-permeable film has mechanical properties (elasticity, resistance to traction, and shrinkage due to temperature or maintenance) that are different from those of the textile support to which it is generally attached. These differences in behavior directly affect the interface between the textile support and the film and quickly lead to localized tearing of the adhesive and may lead to it becoming completely detached.

In order to remedy these drawbacks, it has been envisioned to directly use a microporous polymer film or layer to make up an insert. Nonetheless, such films or layers do not have sufficient mechanical resistance.

In U.S. Pat. No. 4,863,788, to Bellairs et al., a thin microporous membrane formed of polyvinylidene fluoride (PVDF) was attached to one surface of a woven nylon taffeta. While the fabric was waterproof and breathable, the product was stiff due to polymer solution striking completely through the fabric, and due to the relative inflexibility of the microporous membrane in comparison to the fabric. Further, the membrane delaminated completely from the fabric after only 5 wash and dry cycles. The membrane surface was easily damaged by abrasion, causing the film-coated fabric to lose its waterproof character. Therefore, Bellairs et al. turned to the use of a polyurethane foam to attach a thin microporous membrane to one surface of a textile to convert the textile to a waterproof and breathable textile product. For example, a nylon taffeta textile was converted to a waterproof and breathable fabric product by first adhering a thin polyurethane foam layer (@ 0.1 mm) to one surface of the fabric without allowing penetration of the foam into the fabric or textile substrate; then, a PVDF microporous film layer was formed on the surface of the thin open celled polyurethane foam layer. The resulting coated fabric exhibited no stiffness or strikethrough of the polymer, and samples withstood twenty wash and dry cycles with no delamination. The samples also exhibited excellent resistance to abrasion and damage of the microporous layer.

Nevertheless, the textile product of Bellairs et al. is difficult to produce, and the thin microporous layer, once damaged, loses its waterproofness. Therefore, it is desired to produce a waterproof and breathable textile product which will be sufficiently flexible and which will retain its waterproof properties even if the surface of the waterproof and breathable coating is slightly damaged, and yet which can be produced in a simpler manner than prior art breathable inserts.

Thus, objects of the present invention include providing an insert which does not have the drawbacks exhibited by prior art waterproof and breathable textiles, producing a textile whose properties can be controlled and which is pleasing to the touch and to the eye, and which fulfills the conditions required for use of such a textile product in the clothing industry, i.e. sufficient mechanical resistance, resistance to dry cleaning and washing, resistance to abrasion and rubbing which occur when clothes are worn.

SUMMARY OF THE INVENTION

These and other objects of the present invention are achieved by a breathable and water impermeable insert intended for use in the clothing industry, comprised of a microporous polymer foam layer partially embedded into a textile substrate. The microporous layer is in the form of a stable foam so that it is more flexible than prior art microporous membranes, and the layer is reinforced by the textile substrate. In a preferred, embodiment, a dimensionally stable microporous foam of about 0.5 to 1 mm thickness is applied to a textile substrate, and partially embedded in the textile by the use of pressure. Preferably the foam penetrates at least about 5% and up to about 30% into the thickness of the substrate, thus maintaining the fabric feel. In a preferred embodiment, the foam is formed of polyurethane, and the density and thickness of the foam are adjusted to obtain the desired feel to the resulting product while achieving the desired breathability characteristics. In a preferred embodiment, the resulting breathable foam coated textile product retains at least 80% of the elasticity of the textile substrate.

DESCRIPTION OF THE DRAWINGS

The invention will be described in detail with reference to the drawings provided herewith, wherein.

DETAILED DESCRIPTION OF THE INVENTION

Figure 1:
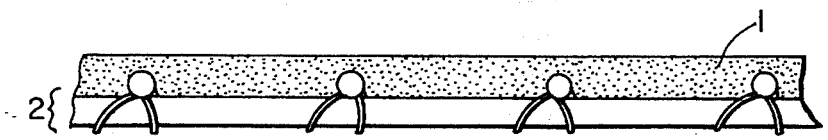
FIG. 1 is a cross-sectional view of a portion of an insert according to the present invention.

The present invention relates to breathable and liquid water-impermeable inserts intended for use in the clothing industry.

Prior art inserts are currently used by inserting them on the inside of clothes in such a way that the qualities and properties of the cloth itself are modified. Such inserts are most often placed between the cloth and the lining.

Inserts can be assembled in flounces, which are then made solid by being surrounded by cloth or lining. They can also be counter-glued to the cloth or lining. In the later case, discontinuous gluing is preferable as it leaves the cloth supple and pleasant to the touch.

With reference to the Figures, an insert is comprised of a microporous foam polymer layer 1 and a textile substrate 2. The foam polymer layer is in the form of a stable foam, in contrast to prior art microporous thin films, and this foam layer is mechanically reinforced by the textile substrate. A major advantage of the present invention is that, unlike prior art inserts such as that of Bellairs et al., discussed earlier, waterproof and breathable properties are exhibited by a single flexible foam layer embedded into a textile substrate, without the need for a microporous membrane. Because the waterproof and breathable layer is a foam, a scratch on the surface is less likely to result in the loss of its waterproof properties than a scratch on the thin microporous film layers used by the prior art. Further, the inserts of the present invention are easier to produce, and, due to the embedding of the waterproof, breathable foam layer in the textile substrate, the foam layer is reinforced, yet the product retains most of the flexibility characteristics of the textile. For example, in a preferred embodiment, the combined foam/textile product has greater than 80% of the elasticity of the uncoated textile.

The foam used is dimensionally stable, yet flexible. It remains in this form during its preparation and manufacturing of the composite textile foam product. After drying, the foam produces a microporous foam layer.

In a preferred embodiment, the foam is formed of a polyurethane obtained by stirring a mixture of foam precursors and water in equal parts. Non-limiting examples of such dimensionally stable foam polymer-forming precursors are marketed under the name "TUBICOAT MP" by the company "CHEMISCHE FABRIK TUBINGEN R. R. BEITLICH GmbH". The foam layer is mechanically reinforced by a textile substrate 2, and the uncoated textile substrate is most often completely liquid water and vapor permeable. It is thus possible, by choosing textile substrate 2, to control the insert's resistance to traction and tearing. For example, when elasticity in the direction of the weft is sought, a textile substrate 2 having the same kind of elasticity is used to reinforce the microporous polymer layer 1.

A feature of the present invention is the ability to retain a greater degree of the flexibility and feel of the textile substrate to which the breathable foam layer is attached than prior art inserts formed from a textile with an embedded thin microporous membrane. Frequently, such microporous membranes lack the elasticity of the textile, while a microporous foam, due in part to its loft is more flexible. Thus, in one aspect, the present invention involves embedding a breathable microporous foam formed by a flexible polymer at least partially into a textile substrate. Inserts encompassed by the present invention are permeable to water vapor, but have a minimum impermeability of over about 1,000 mm of water.

The textile substrate 2 preferably has a low grammage, e.g., 10–80 g/m$^2$, for example from 10 to 50 g/m$^2$, or between 20 and 80 g/m$^2$. An insert made in this way has good mechanical resistance without its grammage becoming too great.

The textile substrate 2 can also be an unwoven, woven, or knitted textile. It is preferable that the textile substrate have an open texture to allow for and facilitate penetration of the foam into the textile during manufacture of the breathable product.

In a first embodiment, the stable foam permeates at least about 5% up to about 30% into the thickness of the textile substrate.

Figure 2:
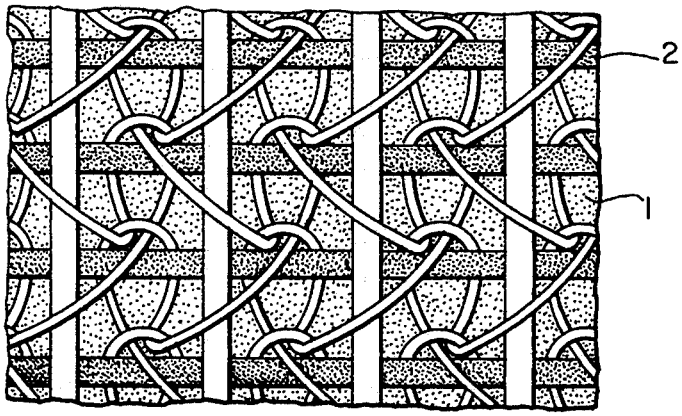
FIG. 2 is a top plan view of the fabric side of an insert according to a first embodiment of the present invention.

The textile substrate can be a wefted knit as represented in FIGS. 1 and 2.

In an alternative embodiment of the invention, two microporous foam polymer layers 1 are applied to opposite sides of the textile substrate 2, thus leading to complete coverage of the opposed surfaces the textile substrate 2 by the polymer foam.

The properties of the textile substrate also allow the clothing properties of the insert to be determined. As indicated above, it is possible to limit penetration of the foam into the textile substrate in such a way as to leave the fabric surface or side opposite of the foam intact. Scraping or polishing the intact side allows the insert to have the feel of the corresponding cloth and to increase its resistance to abrasion.

Furthermore, it has been discovered that, by altering the grammage and density of the foam used, the qualities of liquid water impermeability and vapor breathability of the insert can be varied.

In fact, the surprising discovery that, by proper adjustment of the density and thickness of a foam layer, that a waterproof and breathable layer could be formed, eliminates the need for use of a thin, microporous, waterproof, breathable membrane. The prior art has used a microporous foam as an adhesive for thin, microporous breathable membranes, but did not recognize that, by increasing the density and/or thickness of the foam, a microporous foam could be used by itself in combination with a textile substrate to form a breathable insert.

In order to make a thermoadhesive insert, a discontinuous thermoadhesive layer, (e.g., distributed in points or "dots") is deposited on one and/or both sides of the insert. To maintain the desirable properties of a thermoadhesive insert (breathability and flexibility), the thermoadhesive layer must be discontinuous. Suitable discontinuous thermoadhesive layers can be produced through use of spray-on polymers. Polymers currently used as adhesives in the textile industry can be used here, including thermoplastics or thermosetting substances (e.g., polyethylene, polyester, polyamide, polyurethane . . . ).

In order to manufacture inserts according to the invention, a stable foam is first produced from a mixture of foam polymer precursors and water. It is important that the foam have the correct thickness and density to produce a waterproof and breathable layer. Referring again to the Figures, a layer of a flexible polymer foam 1 is contacted with a textile substrate 2. The polymer foam layer is dried and the product obtained is finally passed through a cold calendar 3 so as to flatten the structure of the foam in order to improve adhesion of the foam to the textile substrate and to increase the complex's resistance to abrasion.

Figure 3:
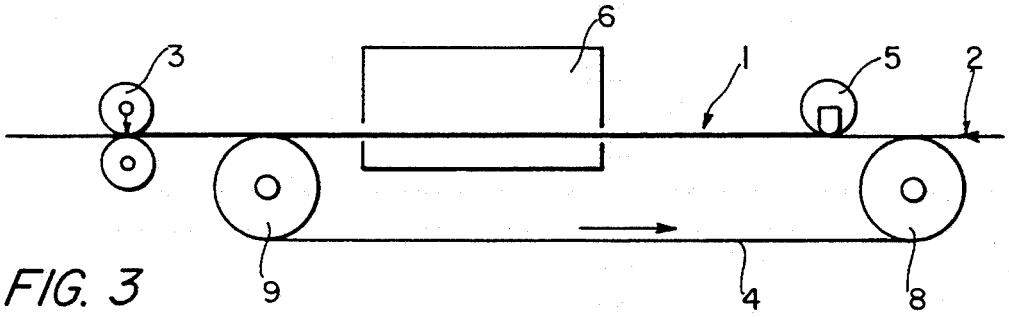
FIG. 3 represents a first embodiment of a system (apparatus) for carrying out an embodiment of the present invention.
Figure 4:
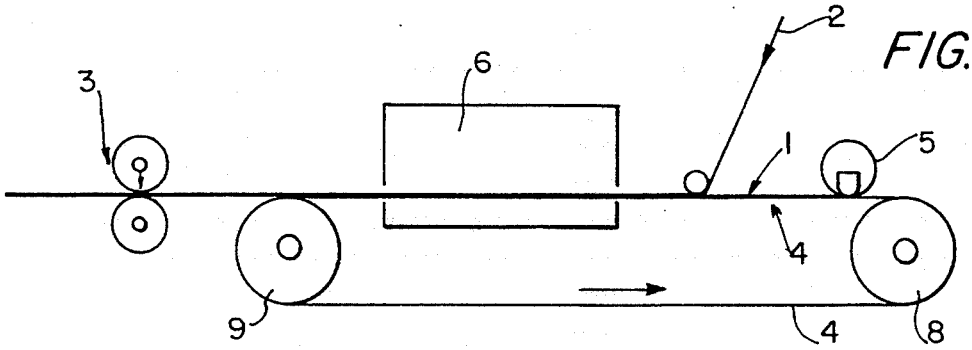
FIG. 4 represents a second embodiment of a system for carrying out an embodiment of the present invention.

The stable polymer foam will be coated either (a) directly onto the textile substrate (FIG. 3), or (b) onto a continuous anti-adhesive support 4 with the foam subsequently contacted with the textile substrate 2 (FIG. 4).

With reference to FIG. 3, when coating is carried out directly, the textile substrate 2 can be supported on a continuous anti-adhesive support 4. A continuous support 4 forms a closed-loop conveyor belt circulating at a constant rate around rollers 8 and 9.

Coating of the polymeric foam can be carried out using known methods, such as by application onto a rotary frame or by scraping with a knife. For example, a rotary frame with a foam scraper 5 can be used. This technique allows varying thicknesses of foam to be applied by adjusting the distance between the knife and the support depending on the product desired. In the embodiment of the invention shown in FIG. 3, the polymer foam is directly spread onto the textile substrate 2 and the foam coated textile dried in one or more ovens, such as oven 6. In one embodiment, while passing through the ovens, a first drying stage takes place at about 100° C., and then a second drying stage takes place at a temperature ranging from about 120° C. to 130° C. so as to consolidate the foam's structure. The microporous structure is then dry and dimensionally stable. As mentioned above, the complex then passes through a cold calendar 3. The pressure exerted on the calendar allows the degree of penetration of the textile substrate 2 into the polymer foam to be defined.

Calendaring is used to apply pressure to the composite to make the foam layer penetrate into the textile substrate 2. This operation can also be carried out by pressing. In a preferred embodiment, the foam penetrates about 5% up to about 30% through the thickness of the textile.

Figure 5:
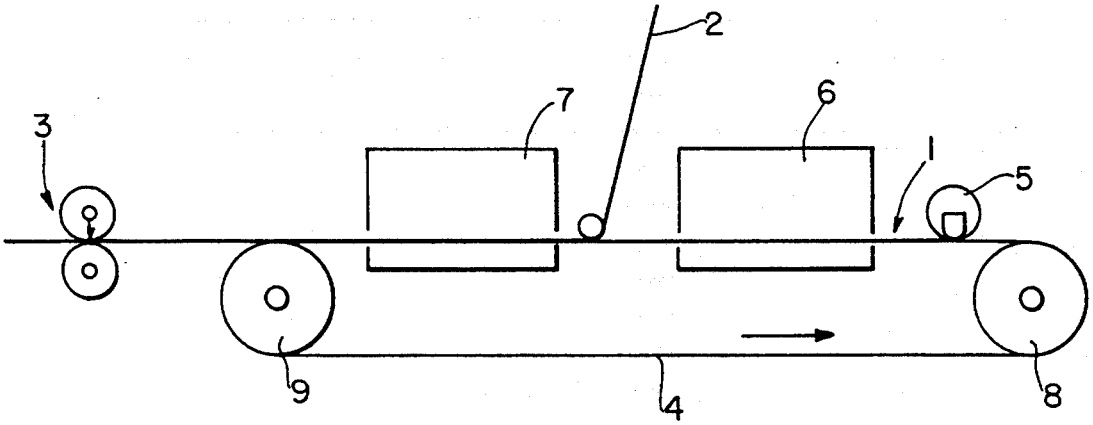
FIG. 5 represents a third embodiment of a system for carrying out an third embodiment of the present invention.

Calendaring can be carried out on the still-humid stable foam before any drying is carried out, or after the first drying stage at 100° C. For example, with reference to the embodiment illustrated in FIG. 5, the microporous layer 1 is contacted with the textile substrate 2 between an oven 6 at 100° C. and an oven 7 at 130° C.

Figure 6:
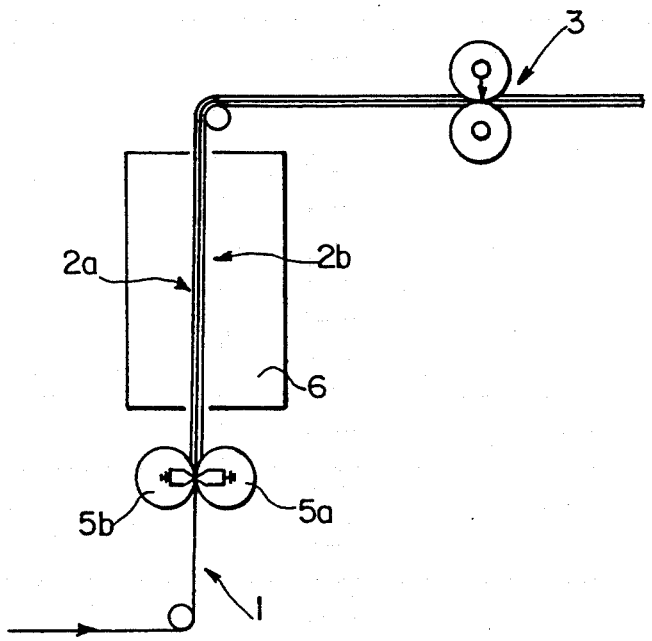
FIG. 6 represents a fourth embodiment of a system for carrying out an embodiment of the invention using two layers of foam.

In another embodiment of the process illustrated in FIG. 6, two foam layers 1*a* and 1*b* are each simultaneously deposited on opposite sides of the textile substrate 2 by a double rotary frame with foam scrapers 5*a* and 5*b*. The opposite sides of the substrate are thereby completely embedded in the foam. In a preferred embodiment the two opposed layers penetrate from opposite sides of the fabric from about 5% up to about 30% into the thickness of the fabric.

In some applications, fireproof qualities for the insert are sought, and can be obtained by selecting suitable fire-retardant compounds. The textile substrate is then resistant to fire due to fireproof additives incorporated into the foam layer.

The hydrophobic properties of the insert can be improved by passing the composite foam-textile product through a waterproofing solution before pressing.

The polymer foam preferably has a density of about 200 to 400 g/l before coating, and about 100–200 g/l after coating, drying and calendaring. In a preferred embodiment, the application of 50 to 100 grams of foam per square meter of product g/m$^2$, produces a foam layer having a thickness ranging from about 0.5 to 1 mm.

The use of textile substrate 2, comprised of a textured knit with insertion of a polyester-based weft having a grammage of 40 g/m$^2$ with an elasticity of 30% in the direction of the weft, allows the insert produced to have an elasticity in the direction of the weft since the foam used to cover the textile substrate also has elasticity.

Coating can be carried out by using a 14-mesh rotary frame with a coating rate of 40% of stable foam at 200 g/l. Drying is carried out in stages starting at 100° C. and ranging up to 130° C.

In a preferred embodiment, an insert having a dry grammage of 90 g/m$^2$ and showing the semi-permeable "breathable" characteristics sought is thus obtained.

To test the durability of inserts produced according to the present invention, preferred inserts produced as discussed immediately above, were subjected to numerous wash and dry cycles. Each of the wash and dry cycles lasted 1 hour and 45 minutes. Washing was conducted at a temperature of 45° C. in a detergent. An example of a suitable detergent is ERGON washing powder, sold by DISCONET of Saint-Quentin, France. Drying was performed using hot air. The inserts were subjected to at least 10 cycles without any evidence of delamination.

To determine the degree of penetration of the foam into the textile, a light microscope was used (WILL STRUBIN, WETZLAR No 883743, at a magnification of 45). The grade of penetration was determined by taking a cross section of the textile product and placing the cross section under the microscope.

Thus, an improved fabric insert has been produced which is breathable, yet retains the feel and flexibility of a textile substrate. Further, inserts produced according to the present invention do not use a thin fragile microporous membrane, thus eliminating the need for an additional coating on top of the microporous layer to protect the microporous layer. In fact, by use of a suitably elastic microporous foam layer, the resulting insert retains most of the elasticity of the starting textile. For example, a polyester-based weft, having a grammage of 40 mg/m$^2$ with an elasticity of 30% in the direction of the weft will produce an insert as above having an elasticity in the direction of the weft of 25–30% (i.e., the product retained greater than 83.33% of the elasticity of the uncoated textile).

Preferred inserts produced in accordance with the present invention have an impermeability of over 1,000 mm of water, complete impermeability to wind, resistance to water vapor of about $60 \cdot 10^{-3}$ to $80 \cdot 10^{-3}$ millibars per m$^2$/w, and have an elasticity in the direction of the weft of about 25 to 30%.

While preferred embodiments of the present invention have been disclosed herein, it is to be understood that the invention can be practiced other than as specifically described.

What is claimed is:

1. An insert for use in the clothing industry, said insert comprising a microporous polymer foam layer and a textile substrate, wherein:

said microporous foam layer permeates said textile substrate and said textile substrate mechanically reinforces said microporous foam layer, said foam layer penetrating at least about 5% and up to about 30% into said substrate;

said textile substrate is an open-textured knit or weave, and has a grammage ranging from 10 to 80 $g/m^2$; and said insert has a resistance to water vapor of about $60 \cdot 10^{-3}$ to $80 \cdot 10^{-3}$ millibars per $m^2/w$ and a resistance to liquid water of 1000 mm of water, whereby said insert is permeable to water vapor and impermeable to liquid water.

2. The insert of claim 1, wherein the elasticity in the direction of the weft is greater than about 80% of the elasticity of said textile substrate without said foam.

3. The insert of claim 2, wherein said elasticity in the direction of the weft is about 25–30%.

4. The insert of claim 1, wherein said foam comprises polyurethane which is free of fillers.

5. Insert according to claim 4, wherein said insert has at least one outwardly facing surface coated with a discontinuous thermoadhesive layer.

6. A water vapor permeable and liquid water impermeable insert for use in the clothing industry, comprising a microporous polymer layer, and a textile substrate, wherein said microporous layer comprises a stable foam, and said layer permeates said textile substrate, said layer penetrating at least about 5% and up to about 30% into said substrate, said foam comprising polyurethane, said layer being mechanically reinforced by said textile substrate, said textile substrate being an open-textured knit or weave and having a grammage ranging from 10 to 80 $g/m^2$, whereby said insert is impermeable to liquid water, and said textile substrate being an open-textured knit or weave.

7. A water vapor permeable and liquid water impermeable insert for use in the clothing industry, comprising first and second microporous polymer foam layers, and a textile substrate having opposed first and second sides, said first foam layer being located on said first side of said textile substrate and said second foam layer being located on said second side of said textile substrate, wherein:

said foam layers penetrate at least about 5% and up to about 30% into said first and second sides, respectively, and said textile substrate reinforces said foam layers;

said textile substrate is an open-textured knit or weave and has a grammage ranging from 10 to 80 $g/m^2$; and said insert has a resistance to water vapor of about $60 \cdot 10^{-3}$ to $80 \cdot 10^{-3}$ millibars per $m^2/w$ and a resistance to liquid water of 1000 mm of water, whereby said insert is permeable to water vapor and impermeable to liquid water.

8. The insert of claim 6, wherein said foam comprises polyurethane which is free of fillers.

9. The insert of claim 7, wherein said foam comprises polyurethane which is free of fillers.

* * * * *